United States Patent [19]

Adelman

[11] Patent Number: 4,859,416

[45] Date of Patent: Aug. 22, 1989

[54] SUPERALLOY COMPOSITIONS AND ARTICLES

[76] Inventor: Stuart Adelman, 135 Carl St., San Francisco, Calif. 94117

[21] Appl. No.: 27,555

[22] Filed: Mar. 17, 1985

Related U.S. Application Data

[63] Continuation of Ser. No. 840,515, Mar. 17, 1986, abandoned.

[51] Int. Cl.[4] ..... C22C 19/05

[52] U.S. Cl. ..... 420/443; 148/404; 420/445; 420/452

[58] Field of Search ..... 420/443, 445, 452; 148/410, 428, 427, 404

[56] References Cited

U.S. PATENT DOCUMENTS

| | | | |
|---|---|---|---|
| 3,124,452 | 3/1964 | Kraft | 420/590 |
| 3,554,817 | 1/1971 | Thompson | 148/404 |
| 3,564,940 | 2/1971 | Thompson et al. | 148/404 |
| 3,671,223 | 6/1972 | Thompson et al. | 148/404 |
| 3,793,010 | 2/1974 | Lempkey et al. | 148/404 |
| 4,012,241 | 3/1977 | Lempkey et al. | 148/404 |
| 4,111,723 | 9/1978 | Lempkey | 148/404 |
| 4,543,235 | 9/1985 | Lempkey et al. | 420/443 |

FOREIGN PATENT DOCUMENTS

| | | |
|---|---|---|
| 549493 | 3/1977 | U.S.S.R. . |
| 1484007 | 8/1977 | United Kingdom . |

OTHER PUBLICATIONS

"The Influence of Off-Axis Reinforcement of the Tensile Strength of an Ni-Al-Cr-C Eutectic Composite", by G. J. May, Journal of Materials Science, 10(1975), 77-82.

"The Fatigue Behavior of an Aligned Ni-Al-Cr-C Eutectic Alloy", G. J. May, Metallurgical Transactions, vol. 6A, May 1975.

"Creep Behavior of a Ni-$Ni_3Al$—$Cr_3C_2$ Eutectic Composite", Bullock et al., Acta Metallurgica, vol. 25, pp. 333—334, 1977.

"The Contribution of Fibre Reinforcement to the Tensile and Creep Strengths of —[1]-$Cr_3C_2$ Eutectic Composite", Miles et al., published in the Proceedings of the Second Conference on In Situ Composites, 1976.

"Effects of Alloying Additions and High Rate Solidification on the Mechanical and Oxidation Behavior of the Directionally Solidified—[1]-$Cr_3C_2$ Eutectic", Bullock et al.

"Exeltrodeposition of Rhenium-Nickel Alloys from Ammoniacal Citrate Solution", Fukushima et al. *Kunzoku Hyomem Gijutsu* 36, 198-203, 1985.

"Effect of Rhenium on the Physical Properties of Iron--Nickel Alloys", Doroshek et al. Issled. Premen. Splavov Tugoplavkikh Met., 147-150, 1983.

*Primary Examiner*—R. Dean

*Attorney, Agent, or Firm*—Watson, Cole, Grindle & Watson

[57] ABSTRACT

The addition of small amounts of rhenium, technitium and their mixtures and, optionally erbium, to a nickel based superalloy consisting essentially of 19.3-19.7 weight percent chromium, about 0.5% carbon, about 2.5% iron, the balance essentially nickel, provides enhanced mechanical properties particularly suitable for applications in gas turbine engine components.

7 Claims, No Drawings

SUPERALLOY COMPOSITIONS AND ARTICLES

This is a continuation of application Ser. No. 06/840,515, filed Mar. 17, 1986 abandoned.

TECHNICAL FIELD

This invention relates generally to the field of eutectic superalloys and more specifically to their use in gas turbine engine component manufacture.

BACKGROUND OF THE INVENTION

A nickel-based superalloy known to the art as Nimonic-75 consists of a class of materials which solidify from the molten state according to monovariant eutectic reactions, providing aligned polyphase structures including such systems as the ternary alloys identified as nickel-chromium-carbon and nickel-titanium-chromium-iron. The advantage of alloy compositions of this nature is that the desired microstructure can be achieved over a range of compositions within a qiven system. This provides a substantial increase in the freedom of selection of compositions permitting increased optimization of properties.

It has been recognized in the art that directional solidification can enhance the mechanical properties of a particular alloy. Directional solidification involves the formation of a solid phase, e.g., chromium carbide fibers, during the transition from the molten phase. This solidification usually occurs in a particular axial direction. Continued cooling results in additional solidification in the same axial direction as the initial formation. The resulting solidified alloy is immensely strong in that axial direction. See, e.g., U.S. Pat. No. 4,111,723 to Lemke et al.

The manipulation of alloy compositions to enhance certain properties is known to the art. Slight changes in composition can have dramatic effect on mechanical strength and toughness. Certainly, the concept of directional solidification is based in part on identifying eutectic compositions wherein the chromium carbide fibers form in the molten phase of the alloy to provide a nucleus for further solidification.

The present invention provides superalloys having greatly improved mechanical properties. The superalloys are not dependent upon directional solidification to provide these enhanced properties, although over the ranqe of compositions present in this invention, there are undoubtedly phases wherein eutectic formation occurs. Directional solidification is not critical to desired properties, but is intended to fall within the scope of the appended claims.

The invention comprises an improvement in the mechanical properties of a superalloy through te addition of minor amounts of rhenium and technetium and their mixtures, and optionally erbium. The addition of these materials provides a surprising and unexpected result which can be quantified, in part, by an increase in time to stress rupture at 800° C. of several thousand hours. This unexpected increase permits the use of the improved superalloy in gas turbine engine component manufacture because of its enhanced resistance to failure under stress at high temperatures. Another surprising and unexpected result is that the order of magnitude increase in mechanical properties can be obtained without a corresponding order of magnitude increase in the cost of the improved superalloy.

It is therefore an object of this invention to provide an improved superalloy composition with enhanced mechanical properties.

It is another object of this invention to provide an improved superalloy composition at a price comparable to currently available superalloy compositions.

SUMMARY OF THE INVENTION

The present invention provides an improved superalloy composition which has a nominal composition of about 2.5% iron, 19.3–19.7% chromium, about 0.5% carbon and the balance essentially nickel. To this basic composition are added up to 1% erbium, preferably 0.2–0.7% erbium and further additions consisting of 0.1 to 10 atomic percent of a member selected from the group consisting of technetium and rhenium and their mixtures. In a particularly preferred embodiment, the additions specifically consist of about 2–10 atomic percent rhenium and 10–1000 parts per million technetium.

DETAILED DESCRIPTION OF THE INVENTION

The present invention relates to improved superalloy compositions, specifically nickel based superalloys used in high temperature applications where high mechanical stresses must be endured. The present invention constitutes an improvement over the composition known to the art as Nimonic-75. The present invention combines the basic composition of Nimonic-75 with additions of technetium, rhenium and their mixtures, preferably with the addition of an active element such as erbium and thereby produces a composition which exhibits significantly enhanced utility in gas turbine engine component manufacture.

In addition to the improvements seen in Nimonic-75, it is predicted that similar surprising increases will occur in the related Nimonic superalloys such as Nimonic-80A and Nimonic C263 upon the addition of erbium, rhenium and technetium. According to the McGraw-Hill Encyclopedia of Science and Technology, Volume 9, page 112, ©1977, Nimonic-75 is a nickel-based alloy containing 19.5% chromium, 0.4% titanium, 0.12% carbon and a maximum of 0.5% copper, 5% iron, 1% manganese and 1% silicon.

The basic composition of this invention is 2–3 weight percent iron, 19.3–19.7% chromium, about 0.5% carbon, the balance essentially nickel. To this composition are added up to 1 weight percent erbium (preferably 0.2–0.7 weight percent erbium), from about 0.1 to about 10 atomic percent of an element selected from the group consisting of technetium, rhenium and their mixtures. In the case of rhenium alone, the amount required will be from 2 to 10 atomic percent, preferably 5–9 atomic percent, and in the case of technetium alone, the amount will be from about 10 to 1000 parts per million, preferably 0.02 to about 0.1 weight percent.

In the case of technetium alone, it must be noted that technitium is not a naturally occurring element. Therefore, each atom of technetium must be made rather than mined. The inclusion of large amounts of technetium is therefore practically precluded because with the current technetium production facilities the desirable improved mechanical properties can only now be obtained at prohibitive cost.

The enhanced mechanical suitability of alloy having the composition described above is more clearly understood with reference to Table 1. In Table 1, the stress rupture time of a sample of the alloy is shown to increase from 55 hours at 800° C. to 4300 hours at 800° C. upon the addition of rhenium and technetium. The improvement shown upon the addition of minor amounts of rhenium and technetium is shown with the last two entries in Table 1. In particular, the stress rupture time increases nearly ten fold by the addition of approximately 480 parts per million of technetium. This result could not be anticipated from the previous art and the resulting dramatic increase in mechanical suitability provides a surprising and unexpected result.

TABLE 1

| Stress Rupture Time at 10 kg/mm$^2$ in Hours @ 800° C. | % Re | % Re + % Tc |
|---|---|---|
| 55 | 0 | 0 |
| 55 | 1.5 | 0.5 5 ppm |
| 160 | 2 | 1 5 ppm |
| 260 | 2.5 | 2 5 ppm |
| 320 | 4 | |
| 410 | 6 | 2 10 ppm |
| 500 | 8 | 4 20 ppm |
| 590 | 10 | 6 20 ppm |
| 4300 | | 6 500 ppm |
| Stress Rupture Time | | |
| @ 4–6 kg/mm$^2$ and 900° C. = 300 hours | 9.5 | |
| @ 2–4 kg/mm$^2$ and 1000° C. = 300 hours | 9.5 | |

Materials of this composition can be cast according to the well known techniques described in U.S. Pat. Nos. 3,124,542; 3,260,505; and 3,495,709. The mechanical properties of the subject improved superalloy make it particularly well suited to the high-high stress environment of gas turbine engines, more specifically the turbine blade.

While the subject invention has been described with respect to a particularly preferred embodiment, it will be apparent to those skilled in the art that certain modifications may be made which are intended to be within the scope of the appended claims.

I claim:

1. A superalloy composition consisting essentially of about 19.3 to 19.7% chromium, 0.5% carbon, 2 to 3% iron, and the balance essentially nickel, said composition being free of an amount of aluminum sufficient to form a substantial quantity of Ni-Al-Cr-C eutectic composite, said composition further comprising 0 to 1% erbium and 0.1 to 10 atomic percent of an element selected from the group consisting of rhenium, technetium and mixtures thereof, said superalloy composition having improved mechanical properties independent of directional solidification thereof.

2. A superalloy composition as claimed in claim 1, in which said element is rhenium.

3. A superalloy composition as claimed in claim 2, in which said rhenium is present in about 2 to 10 atomic percent.

4. A superalloy composition as claimed in claim 2, in which said rhenium is present in about 5 to 9 atomic percent.

5. A superalloy composition as claimed in claim 1 in which said element is technetium.

6. A superalloy composition as claimed in claim 1, in which said erbium is present in about 0.2 to 0.7%.

7. A gas turbine engine component made from a superalloy composition as claimed in claim 1 herein.

* * * * *